United States Patent [19]

Randall

[11] Patent Number: 4,652,112

[45] Date of Patent: Mar. 24, 1987

[54] COMPACT CONSOLE ELECTROGRAPHIC REPRODUCTION APPARATUS

[75] Inventor: Kent A. Randall, Rochester, N.Y.

[73] Assignee: Eastman Kodak Company, Rochester, N.Y.

[21] Appl. No.: 807,723

[22] Filed: Dec. 11, 1985

[51] Int. Cl.[4] ..... G03G 15/00

[52] U.S. Cl. ..... 355/3 R; 355/14 R

[58] Field of Search ..... 355/3 R, 14 R, 3 SH, 355/14 SH, 3 DR, 3 BE

[56] References Cited

U.S. PATENT DOCUMENTS

| | | | |
|---|---|---|---|
| 4,538,906 | 9/1985 | Brown | 355/14 SH |
| 4,562,444 | 12/1985 | Nagashima et al. | 355/14 SH X |
| 4,563,082 | 1/1986 | Sato | 355/14 SH |
| 4,566,782 | 1/1986 | Britt et al. | 355/14 SH |

*Primary Examiner*—A. C. Prescott

*Attorney, Agent, or Firm*—Lawrence P. Kessler

[57] ABSTRACT

A feature rich, compact console electrographic reproduction apparatus having ready access to the entire receiver sheet transport path, improved thermal management, and the capability of performing automatic two-pass duplex copying or two-pass image overlaying. A first assembly, mounted for movement through a front wall of the apparatus housing for ready access, includes receiver sheet stack holders, respective receiver sheet feeders, a mechanism for receiver sheet transport to a dielectric member, and a mechanism for effecting transfer of a transferable image from such member to a receiver sheet. A second assembly, mounted for movement through the front wall of the apparatus housing for ready access, includes a mechanism for receiver sheet transport from the dielectric member, an image fixing mechanism, and a stacker for fixed image hearing receiver sheets. An auxiliary receiver sheet supporting tray, in the second assembly, includes a mechanism for selectively stacking receiver sheets in such tray in particular facial orientations which respectively enable duplex copy or image overlay copy to be automatically reproduced on receiver sheets returned from such tray to the dielectric member. A blower and associated baffling, located in the apparatus housing, directs incoming fresh air through a substantial opening in the front of such housing in a swirling pattern through its interior and exhausts such air through an opening in the bottom of the housing.

15 Claims, 3 Drawing Figures

COMPACT CONSOLE ELECTROGRAPHIC REPRODUCTION APPARATUS

BACKGROUND OF THE INVENTION

This invention relates in general to electrographic reproduction apparatus, and more particularly to a compact console electrographic reproduction apparatus having ready access to the entire receiver sheet transport path for jam clearance, improved thermal management, and capability of performing automatic two-pass duplex copying or two-pass image overlay copying.

Electrographic reproduction apparatus presently available in the market place range from small personal copiers with a relatively low copy rate (e.g. 10 copies per minute) to duplicators with a substantially higher copy rate (e.g. in excess of 100 copies per minute). It can generally be said that as the copy rate increases, the size of the apparatus increases as does its complexity. Of course the larger, faster apparatus tend to incorporate added features such as multiple receiver sheet supplies, automatic duplex copying capabilities, or the ability to add image overlays to reproductions.

Such feature rich apparatus require proportionately more space than smaller apparatus in order to access their interior, for jam clearance for example, and to provide adequate thermal management (i.e., the ability to remove heat and airborne contaminants from various components to maintain a suitable temperature and air quality within the apparatus and its environment). Moreover, the ability to do both automatic duplex copying and add image overlays to reproductions has not typically been incorporated in a single reproduction apparatus. This is because the transport path for receiver sheets in making duplex copies requires a turn over for the sheets to present their opposite sides for duplex copying, while the transport path for receiver sheets in adding image overlays necessitates that the receiver sheets remain in the same facial orientation to the electrographic process station in order to place the image overlays on the same side thereof as the initial reproduction.

SUMMARY OF THE INVENTION

This invention is directed to a feature rich, compact console electrographic reproduction apparatus having ready access to the entire receiver sheet transport path, improved thermal management, and the capability of performing automatic two-pass duplex copying or two-pass image overlaying particularly for accent color copying. The apparatus includes a housing having interconnected top, bottom, front, and side walls. An operator control panel is located on the top wall of the housing adjacent to the front wall. A dielectric member is supported in the housing for movement about a closed loop path. Mechanisms, located in the housing in ordered association with the closed loop path, apply a uniform charge to the dielectric member, alter such charge to form a charge pattern corresponding in image-wise fashion to information to be reproduced, and develop such image-wise charge pattern with pigmented, transferable marking particles to form a transferable image. A first assembly is mounted in the housing for movement through the front wall to a first position in operative association with the closed loop path downstream of the developing mechanism and to a second position external of the housing for ready access to such first assembly. The first assembly includes the following components: (1) a receiver sheet stack holder, (2) a feeder for feeding receiver sheets seriatem from the stack into a transport path, (3) a mechanism for transporting receiver sheets along the transport path, a portion of which is in transfer relation with the closed loop path of the dielectric member when such assembly is in its first position, and (4) a mechanism located adjacent to such path portion for effecting transfer of a transferable image to a receiver sheet in the transport path portion when such assembly is in its first position. A second assembly is mounted in the housing for movement through the front wall to a first position in operative association with the first assembly in its first position and to a second position external of the housing for ready access to the second assembly. The second assembly includes the following components: (1) a mechanism for transporting receiver sheets along a path extending away from the closed loop path of the dielectric member when the second assembly is in its first position, (2) a mechanism in juxtaposition with the path extending away from the closed loop path for permanently fixing an image transferred to such sheet, and (3) a stacker for stacking receiver sheets bearing fixed images for ready operator retrieval.

To provide the capability for automatic two-pass duplex copying or two-pass image overlaying particularly for accent color copying, the second assembly further includes an auxiliary receiver sheet supporting tray into which receiver sheets are directed with a fixed image bearing face having an orientation which corresponds to the facial orientation of such sheet when is the path extending from the closed loop path. In such orientation when such a sheet is returned to the portion of the transport path in transfer relation with the closed loop path, the non-image bearing face of such sheet is facing the closed loop path to receive a transferable image thereon for duplex copying. Alternatively, receiver sheets are directed into the auxiliary tray with a fixed image bearing face having a orientation which is opposite to the facial orientation of such sheet when in the path extending from the closed loop path. In such orientation when such sheet is returned to the portion of the transport path in transfer relation with the closed loop path, the fixed image bearing face of such sheet is facing the closed loop path to receive a transferable image thereon for image overlaying. If the second transferable image is developed with different color marking particles, accent color copying is achieved.

Improved thermal management is achieved by providing a first substantial opening in the front wall of the housing and a second opening in the bottom wall. A blower and associated baffling, located in the housing, directs incoming fresh air through the first opening in a swirling pattern through the housing and exhausts air through the second opening.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENTS

Figure 1:
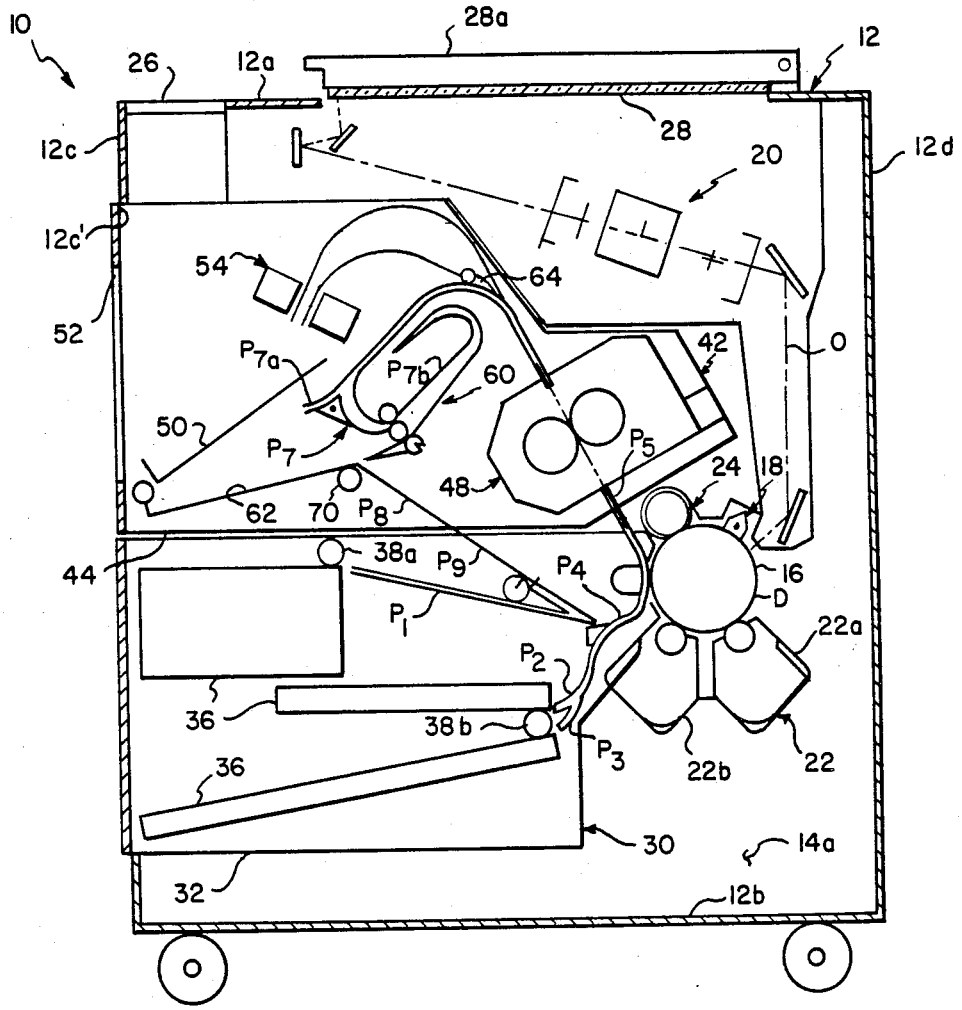
FIG. 1 is a side elevational view, in cross section, of the compact console electrographic reproduction apparatus according to this invention, with portions removed to facilitate viewing.
Figure 2:
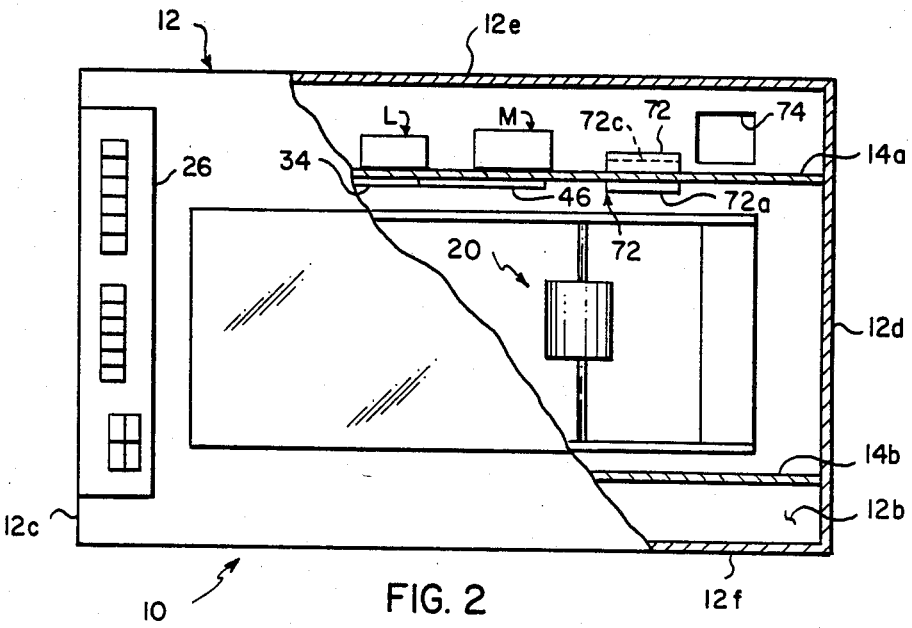
FIG. 2 is a top plan view, partly in cross section, of the apparatus of FIG. 1.

Referring now to the accompanying drawings, a compact console electrographic reproduction apparatus according to this invention is designated generally by the numeral 10 in FIGS. 1 and 2. The apparatus 10 includes a housing 12 having a top wall 12*a*, a bottom wall 12*b*, a front wall 12*c*, a rear wall 12*d* and side walls 12*e* and 12*f*, interconnected along adjacent intersecting edges. The front wall 12*c* has a pair of openings 12*c'* and 12*c''* for the purpose to be explained below. A pair of plates 14*a*, 14*b* are located within the housing 12 and extend substantially from the front wall 12*c* to the rear wall 12*d* in spaced parallel relation to the side walls 12*e* and 12*f*. The plates 14*a* and 14*b* serve to structurally support the internal components of the apparatus 10 as hereinafter described.

A dielectric member D is supported by the plates 14*a*, 14*b* in association with electrographic process stations, also supported by such plates. Such stations operate to form pigmented marking particle developed, transferable images of information to be reproduced on the member D. The dielectric D is, for example, a drum 16 mounted for rotation in a clockwise direction (in FIG. 1) about its longitudinal axis. The drum is rotated by a motor M supported between the plate 14*a* and side wall 12*e* to move the peripheral surface of the drum about a closed loop path. The peripheral surface of the drum has a composite construction including a photoconductive layer and a grounded support layer, such as shown in U.S. Pat. No. 3,615,414 (issued Oct. 26, 1971, in the name of Light) for example. Of course, the member 16 could alternatively comprise a continuous web, formed of similar composite construction, moving about a closed loop path. The electrographic process stations include a charging apparatus 18, an exposure mechanism 20, a developer apparatus 22 and a cleaning mechanism 24.

Under the control of a logic and control unit L, supported between the plate 14*a* and side wall 12*e*, the motor M rotates the drum 16 through operative relation with the electrographic process stations. The unit L includes, for example, a microprocessor receiving input signals from an operator control panel 26 and timing signals based on the angular position of the drum about its longitudinal axis. The operator control panel 26 is located in the top wall 12*a* of the housing 12, adjacent to the front wall 12*c*. Accordingly, such panel is always readily accessible to the operator, as will be appreciated from the description hereinbelow, even when retrieving reproductions, loading receiver sheet supplies, or clearing jams.

Based on the input and timing signals and a program for the microprocessor, the unit L produces signals to control the rotation of the drum 16 and the various electrographic process stations for carrying out the reproduction process. The production of a program for a number of commercially available microprocessors such as the INTEL Model 8080 or Model 8085 microprocessor (which along with others are suitable for use with this invention), is a conventional skill will understood in the art. The particular details of any such program would, of course, depend on the architecture of the designated microprocessor.

In the particular operation of the elctrographic reproduction apparatus 10, the motor M rotates the drum 16 in a clockwise direction to move a portion of the photoconductive layer of its peripheral surface past the charging apparatus 18. The charging apparatus is, for example, a corona charge electrically coupled to a potential source (not shown). A uniform electrostatic charge is deposited by the apparatus 18 on such portion of the drum surface, and such portion then moves past an optical path 0 defined by the exposure mechanism 20. The exposure mechanism includes, for example, a moving mirror/fixed lens scanning assembly such as shown in U.S. Pat. No. 4,402,595 (issued Sept. 6, 1983 in the name of Ogawa et al). Such assembly directs a reflected light image of a document bearing information to be reproduced along an optical path 0 in successive line segments. The optical path extends from an object plane defined by a document-supporting transparent platen 28 to an image plane at the photoconductive layer of the peripheral surface of the rotation drum. The platen 28 (with a pivotable overlying cover 28*a*) is located in the top wall 12*a* of the housing 12 rearwardly of the operator control panel 26 but with ready access by an operator from the front of the apparatus 10. The projected line segments of the reflected light image of the document expose the photoconductive layer and alter the uniform charge pattern thereon to form a charge pattern corresponding in image-wise fashion to the document. Of course, other optical or electronic charge altering mechanisms are suitable for use with this invention.

After the image-wise charge pattern is formed on the photoconductive layer, the portion of the surface of the drum 16 bearing such pattern is moved into operative relation with the developer apparatus 22. As shown in FIG. 1, the developer apparatus 22 includes a pair of magnetic brush developer stations 22*a*, 22*b* which may be of the type described in U.S. Pat. No. 3,457,900 (issued July 29, 1969 in the name of Drexler). The developer stations, respectively containing different color marking particles, are selectively activated by the logic and control unit L to bring the marking particles of a particular color into contact with the photoconductive layer. Such particles adhere to the charge pattern on such layer to develop the pattern into a transferably image. Of course, other types of developer apparatus are suitable for use with this invention. Moreover, the number of developer stations employed may vary from one to four, for example, depending on the number of colors desired to be reproduced by the apparatus 10.

A first assembly 30 is mounted in the housing 12 for movement through the opening 12*c'* in the front wall 12*c* to a first position in operative association with the closed loop path described by the rotating drum 16 and to a second position external of the housing. The assembly 30 comprises a drawer 32 mounted on slide rails 34 supported by the plates 14*a*, 14*b* (see FIG. 2). The drawer 32 contains a plurality of holders 36 (cassettes or trays) adapted to respectively support stacks of receiver sheets of different dimensions or characteristics (e.g. paper weight or color). Suitable feed mechanisms 38*a*, 38*b* are associated with the holders 36 for selectively feeding receiver sheets seriatem from the holders into respective transport paths $P_1$, $P_2$ and $P_3$ where such sheets are urged along by, for example, transport rollers (not shown) to a common transport path $P_4$. A portion of the path $P_4$ is disposed to direct such sheets into transfer relation with the closed loop path of the rotating drum 16 when the assembly 30 is in its first position (FIG. 1). A transfer mechanism 40, such as a corona charger electrically coupled to a potential source for example, is supported in the drawer adjacent to the path $P_4$. The transfer mechanism 40 produces an electrostatic field to effect transfer of a transferable image form the photoconductive layer of the peripheral surface of the drum 16 to a receiver sheet in the path $P_4$ when the assembly 30 is in its first position. It should be noted that after an image is transferred from the photoconductive layer of the peripheral surface of the drum 16, rotation of the drum moves such portion of its surface past the cleaning apparatus 24 where any residual marking particles are removed and returns such portion to the charging apparatus 18 in preparation for reuse.

When the drawer 32 is moved through the opening 12*c*′ in the front wall to locate assembly 30 in its second position, the entire components of the assembly are readily accessible to an operator from the front of the apparatus 10. That is, receiver sheet stacks may be easily loaded or exchanged and the entire sheet transport path within the drawer is exposed to the operator for any necessary jam clearance. At the same time, the operator control panel 26 is still readily accessible to the operator because of the front location of the panel and the assembly 30 in its second position.

A second assembly 42 is mounted in the housing 12 for movement through the opening 12*c*″ in the front wall 12*c* to a first position in operative association with the first assembly 30 when in its first position and to a second position external of the housing. The assembly 42 comprises a drawer 44 mounted on slide rails 46 supported by the plates 14*a*, 14*b* (see FIG. 2). The drawer 44 contains a transport path $P_5$ communicating with path $P_4$ of the first assembly 30 when the first and second assemblies are in their respective first positions. The path $P_5$ extends away from the closed loop path of the rotating drum 16 so that a receiver sheet bearing a transferable image urged along such path by transport rollers (not shown), for example, travels away from the closed loop path. The path $P_5$ directs image bearing sheets into a device 48, supported in the drawer 44, for permanently fixing the transferred image to the sheet by application of heat and/or pressure for example. A transport path $P_6$ extends from the fixing device 48 to an output hopper 50 located in the drawer in juxtaposition with a substantial opening 52 in the front of such drawer. Accordingly, fixed image-bearing receiver sheets in such hopper are retrievable by an operator from the front through opening 52 when the assembly 42 is in its first position.

The transport path $P_6$ may include a device 54 for performing a finishing operation on fixed image-bearing receiver sheets prior to operator retrieval. For example, the device 54 includes a stop member 56 selectively movable into the path $P_6$ to enable a number of sheets sequentially traveling in such path to be collected in a set corresponding to a completed set of information to be reproduced (e.g. a multi-page document), and bound together by a stapler 58. Of course, binding of the sheets could be accomplished in other ways, such as by gluing for example; and the device 54 could be a sorter for collating receiver sheets into desired sets.

The second assembly 42 further includes an auxiliary stacking mechanism 60 (see FIG. 1) for enabling the apparatus 10 to automatically produce, in two passes, duplex copies or image overlay copies. The mechanism 60 includes a receiver sheet supporting tray 62, a transport path $P_7$ communicating between the transport path $P_6$ and the tray 62, and a pivotable diverter 64 for selectively directing receiver sheets transported along path $P_6$ to the hopper 50 or into the path $P_7$. The path $P_7$ has a first portion $P_{7a}$ which communicates directly from the path $P_6$ to the tray 62 and a second portion $P_{7b}$ which turns over a sheet from path $P_6$, in any well known manner, prior to directing the sheet to the tray 62. Accordingly, receiver sheets directed from path $P_6$ by the diverter 64 and directed along path $P_{7a}$ directly to the tray 62 are stacked in the tray with a fixed image bearing face having an orientation which corresponds to the facial orientation of such sheet when in the transport path $P_5$ (i.e. image facing up in path $P_5$ and tray 62). On the other hand, receiver sheets directed from path $P_6$ by the diverter 64 and directed along the path $P_{7b}$ prior to entering the tray 62 are stacked in the tray with a fixed image bearing face having an orientation which is opposite to the facial orientation of such sheet wherein the transport path $P_5$ (i.e. image facing up in path $P_5$ and facing down in tray 62).

A feed mechanism 70 is associated with the tray 62 for feeding stacked receiver sheets from the bottom of the tray seriatem into a transport path $P_8$. When the first assembly 30 and the second assembly 42 are in their first positions, path $P_8$ communicates with a transport path $P_9$ in the first assembly. Path $P_9$, in turn, communicates with transport path $P_4$ so that receiver sheets urged along the paths $P_8$, $P_9$ and $P_4$ by transport rollers (not shown), for example, are returned into transfer relation with the closed loop path of the rotating drum 16. Therefore, receiver sheets stacked in the tray 62 with the above described corresponding facial orientation are returned to transfer relation with the closed loop path in a manner which presents their non-image bearing face to the drum for receiving an image thereof to produce a duplex copy; and, receiver sheets stacked in the tray 62 with the above described opposite facial orientation are returned to transfer relation with the closed loop path in a manner which presents their image bearing face to the drum for receiving an additional image thereon to produce an image overlay copy. As discussed above the apparatus 10 is capable of developing images in different colors. Accordingly, under the control of the logic and control unit L, the images used in producing duplex copies may be of the same color on both sides or different colors as desired; and, the images used in producing image overlay copies may be of the same color, or different colors for the purpose of color accenting such copies as desired.

Figure 3:
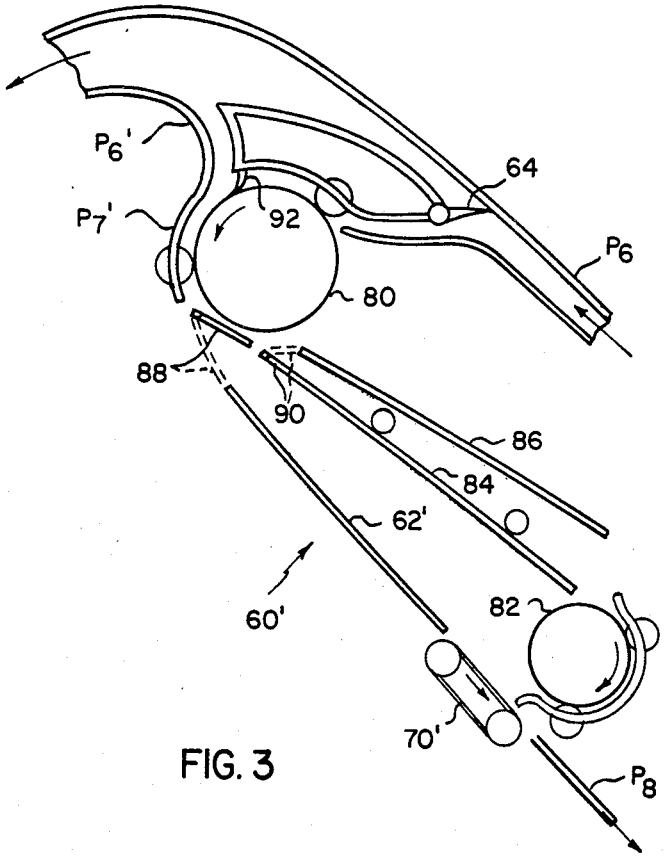
FIG. 3 is a side elevational view, on an enlarged scale, of an alternate arrangement of the structure for providing two-pass duplex or two-pass image overlaying capabilities for the electrographic reproduction apparatus according to this invention.

An alternate arrangement for the auxiliary stacking mechanism 60 is shown in FIG. 3 and designated generally by the numeral 60′. The mechanism 60′ includes a receiver sheet supporting tray 62′ and a transport path $P_7'$, communicating between the transport path $P_6$ and the tray 62′. The pivotable diverter 64 selectively directs receiver sheets for transport along path $P_6$ to the hopper 50 or into the path $P_7'$. The path $P_7'$ includes a first rotating turnover roller 80, a second rotating turnover roller 82, a pair of guides 84 and 86 spaced above the tray 62′, and a pair of diverters 88 and 90. When the diverter 88 is in its phantom line position, a receiver sheet directed into the path $P_7'$ from the path $P_6$ by the diverter 64 is transported directly to the tray 62'. The first roller 80 turns the receiver sheet over so that its facial orientation in the tray 62' is opposite to its facial orientation in the path $P_5$ (i.e., image facing up in path $P_5$ and facing down in tray 62'). On the other hand, when the diverters 88 and 90 are in their full line position, the receiver sheet is transported from the first roller 80 to the second roller 82 along the guide 84 and then into the tray 62' (from the opposite direction with respect to the direct transport to tray 62'). The second roller 82 turns the sheet over again so that its facial orientation in the tray 62' corresponds to its facial orientation in path $P_5$ (i.e., image facing up in path $P_5$ and tray 62') A feed mechanism 70', associated with the tray 62', selectively feeds stacked receiver sheets from the bottom of the tray seriatem into the path $P_8$ in the manner and for the purpose described above with reference to mechanism 70 of FIG. 1.

The alternate arrangement of FIG. 3 further provides a mechanism for turning over receiver sheets (inverting the facial orientation), transported along path $P_6$ to the output hopper 50 if so desired, for example to assure stacking of the receiver sheets in the hopper in a desired order. Such turn over is accomplished by positioning diverter 88 in its full line position and diverter 90 in its phantom line position. A receiver sheet directed into the path $P_7'$ from the path $P_6$ by diverter 64 is transported about the roller 80 to the guide 86. When the trail edge of such sheet passes a flexible blade 92, the rotation of the roller 80 is reversed and the sheet is returned to the path $P_6$ along the path $P_6'$. The blade 92 prevents the sheet from returning to path $P_6$ in the wrong direction. The trail edge of such sheet thus becomes the lead edge and its facial orientation is inverted (i.e., image facing up becomes image facing down) as the sheet travels in path $P_6$ to the hopper 50.

When the drawer 44 of the second assembly 42 is moved through the opening 12c'' in the front wall 12c to locate the assembly 42 in its second position, the entire components of the second assembly are readily accessible to an operator from the front of the apparatus 10. That is, the entire sheet transport path within the drawer is exposed to the operator for any necessary jam clearance for example. At the same time, the operator control panel 26 is still readily accessible to the operator because of the frontal location of the panel and the assembly 42 in its second position. Such frontal access to both assemblies 30 and 42 and their location above one another reduces the size of the apparatus 10 when compared to reproduction apparatus containing similar advanced features (i.e., duplex and image overlay copying capabilities). Moreover, by such arrangement access to the apparatus 10 from the sides is not required (except for maintenance). Therefore, the apparatus takes up less floor space, and can have other office equipment, such as file cabinets for example, placed in close proximity to its sidewalls 12e, 12f. Further, the side walls can be sound insulated to reduce the perceptible noise level of the apparatus.

An additional feature provided by the electrographic reproduction apparatus 10 according to this invention is improved thermal management. Thermal management refers to the ability to control the temperature and air quality within apparatus and its environment at suitable levels. To provide such improved thermal management, the apparatus 10 includes a blower 72 mounted in the plate 14a toward the rear wall 12d (see FIG. 2). The intake 72a for the blower 72 faces the cavity described between the plates 14a and 14b while the exhaust is directed through an appropriate filter 72c into the cavity described between plate 14a and side wall 12e. The substantial opening 12c'' in the front wall 12c of the housing (and opening 52 in the front of assembly 42) provides an inlet capable of admitting a large quantity of fresh air. The blower 72 draws the fresh air into the interior of the apparatus 10 in a swirling pattern over its internal components. If necessary, baffles (not shown) may be provided to aid in the establishment of such swirling pattern. The fresh air maintains the temperature within the apparatus 10 and its environment at a suitable level and carries airborne contaminants to the filter 72c where they are trapped. An opening 74 (see FIG. 2) in the bottom wall 12b of the housing provides an exhaust port for air exhausted from the blower 72. If necessary, baffles or ducting (not shown) may be provided to direct exhaust air to the opening 74. The exhaust air thus exits from the bottom rear of the apparatus 10. This keeps undesirable exhaust air flow away from the operator (at the front of the apparatus).

I claim:

1. A compact console electrographic reproduction apparatus comprising:

a housing including top, bottom, front and side walls interconnected along adjacent intersecting edges;

an operator control panel located on said top wall of said housing adjacent to said front wall;

a dielectric member supported in said housing for movement about a closed loop path;

means, located in said housing and associated with said closed loop path, for applying a uniform charge to said dielectric member;

means, located in said housing and associated with said closed loop path downstream of said charging means, for selectively altering such uniform charge on said dielectric member to form a charge pattern corresponding image-wise to information to be reproduced;

means, located in said housing and associated with said closed loop path downstream of said charge pattern forming means, for developing such image-wise charge pattern with pigmented, transferable marking particles to form a transferable image;

a first assembly mounted in said housing for movement through said front wall to a first position in operative association with said closed loop path downstream of said developing means and to a second position external of said housing for ready access to said first assembly, said first assembly including as components thereof (1) means for holding a stack of receiver sheets, (2) means for feeding receiver sheets seriatem from said stack into a transport path, (3) means for transporting receiver sheets along said transport path, a portion of which is in transfer relation with said closed loop path of said dielectric member when said assembly is in its first position, and (4) means located adjacent to said path portion for effecting transfer of said transferable image to a receiver sheet in said transport path portion when said first assembly is in its first position; and a second assembly mounted in said housing for movement through said front wall to a first position in operative association with said first assembly in its first portion and to a second position external of said housing for ready access to said second assembly, said second assembly including as components thereof (1) means for transporting receiver sheets along a path extending away from said closed loop path of said dielectric member when said second assembly is in its first position, (2) means, in juxtaposition with said path extending away from said closed loop path, for permanently fixing an image transferred to a receiver sheet to such receiver sheet, and (3) means for stacking receiver sheets bearing fixed images for ready operator retrieval.

2. The invention of claim 1 wherein said dielectric member includes a grounded photoconductive layer, and wherein said housing further includes a transparent document supporting platen located in said top wall rearwardly of said operator control panel, and said charge pattern forming means includes means for optically projecting a reflected light image of a document on said transparent platen onto said grounded photoconductive layer.

3. The invention of claim 2 wherein said dielectric member further includes a cylindrical drum mounted for rotation about its longitudinal axis and supporting said grounded photoconductive layer on its peripheral surface.

4. The invention of claim 1 wherein said first assembly further includes a drawer adapted to support said aforementioned components of said first assembly, and means for slidably mounting said drawer in said housing for movement through said front wall.

5. The invention of claim 4 wherein said holding means of said first assembly includes a plurality of receiver sheet stack supporting trays and said feeding means is associated with said plurality of trays respectively for selectively feeding receiver sheets from any of said plurality of trays into said transport path.

6. The invention of claim 4 wherein said second assembly further includes a drawer adapted to support said aforementioned components of said second assembly, and means for slidably mounting said drawer in said housing, above said drawer of said first assembly, for movement though said front wall.

7. The invention of claim 1 wherein said second assembly further includes as drawer adapted to support said aforementioned components of said second assembly, and means for slidably mounting said drawer in said housing for movement through said front wall.

8. The invention of claim 1 wherein said second assembly further includes, as components thereof, auxiliary means for stacking receiver sheets bearing fixed images, and means communicating with said auxiliary stacking means and said transport means of said first assembly for feeding receiver sheet seriatem from said auxiliary stacking means to said transport means of said first assembly.

9. The invention of claim 8 wherein said auxiliary stacking means includes a receiver sheet supporting tray, means for directing receiver sheets into said tray with a fixed image bearing face having an orientation which corresponds to the facial orientation of such sheet when in said path extending from said closed loop path whereby when such sheet 15 returned to said portion of said transport path in said transfer relation with said closed loop path, the non-image bearing face of such sheet is facing said closed loop path to receive a transferable image thereon, and means for directing receiver sheets into said tray with a fixed image bearing face having an orientation which is opposite to the facial orientation of such sheet when in said path extending from said closed loop path whereby when such sheet is returned to said portion of said transport path in transfer relation with said closed loop path, the fixed image bearing face of such sheet is facing said closed loop path to receive a transferable image thereon.

10. The invention of claim 9 wherein said developing means includes a first developer station containing pigmented marking particles of a first color, a second developer station containing pigmented marking particles of a second color, and means for selectively activating said first or second developer station to effect developing of an image-wise charge pattern with particles of said first or second color to form a transferable image of said first or second color, and means for controlling said selective activating means to enable receiver sheets from said holding means of said fist assembly to receive transferable images of said first or second color on a particular face thereof, and receiver sheets from said auxiliary stacking means of said second assembly to receive images of said first or second color on an opposite face to produce duplex copies or to receive images of said first or second color on a like face to produce overlaid copies with like or different colors.

11. The invention of claim 8 wherein said second assembly further includes, as a component thereof, means located between said auxiliary stacking means and said stacking means for selectively performing a finishing operation on receiver sheets bearing a fixed images prior to operator retrieval.

12. The invention of claim 11 wherein said finishing means includes means for collecting a predetermined number of receiver sheets constituting a completed set of reproduced information and means for stapling such predetermined receiver sheets together.

13. The invention of claim 1 wherein said housing contains thermal management means for maintaining suitable temperature and air quality conditions within said housing and its environment.

14. The invention of claim 13 wherein said thermal management means includes a first substantial opening defined in said front wall of said housing and a second opening defined in said bottom wall thereof, a blower located within said housing, and baffling means for directing incoming fresh air through said first substantial opening in a swirling pattern through the housing to said blower and exhaust air from said blower through said second opening.

15. The invention of claim 1 wherein access to the interior of said housing is only through said front wall thereof, leaving said side walls free from the need to provide access, whereby additional office equipment may be placed in close proximity to said side walls.

* * * * *